US005756433A

United States Patent [19]

Auschra et al.

[11] Patent Number: 5,756,433

[45] Date of Patent: May 26, 1998

[54] LUBRICANT ADDITIVES

[75] Inventors: Clemens Auschra, Mainz; Horst Pennewiss, Darmstadt, both of Germany

[73] Assignee: Roehm GmbH Chemische Fabrik, Darmstadt, Germany

[21] Appl. No.: 652,276

[22] Filed: May 22, 1996

[30] Foreign Application Priority Data

May 22, 1995 [DE] Germany ..... 195 18 786.5

[51] Int. Cl.[6] ..... C10M 145/14

[52] U.S. Cl. ..... 508/469; 508/470; 525/309; 526/320

[58] Field of Search ..... 508/469, 470; 525/309; 526/320

[56] References Cited

U.S. PATENT DOCUMENTS

| | | | |
|---|---|---|---|
| 3,304,260 | 2/1967 | Fields et al. | 508/469 |
| 4,867,894 | 9/1989 | Pennewiss et al. | 508/469 |
| 5,188,770 | 2/1993 | Pennewiss et al. | 508/469 |
| 5,254,632 | 10/1993 | Kerscher et al. | 525/309 |
| 5,368,761 | 11/1994 | Gore et al. | 508/469 |
| 5,483,003 | 1/1996 | Siol et al. | 525/309 |
| 5,565,130 | 10/1996 | Omeis et al. | 508/469 |
| 5,622,924 | 4/1997 | Sakai et al. | 508/469 |

FOREIGN PATENT DOCUMENTS

| | | |
|---|---|---|
| 0 621 293 | 10/1994 | European Pat. Off. . |
| 1 053 529 | 1/1967 | United Kingdom . |

*Primary Examiner*—Jacqueline V. Howard
*Attorney, Agent, or Firm*—Oblon, Spivak, McClelland, Maier & Neustadt, P.C.

[57] ABSTRACT

A composition comprising a carrier and a comb copolymer made by copolymerizing a polyalkyl (meth)acrylate macromonomer, present in an amount of 10–90 wt %, with the following monomers in a total amount of 90–10 wt %:

(a) 0–90 wt % of $C_6$–$C_{30}$ alkyl (meth)acrylates, (b) 0–60 wt % of nonfunctionalized comonomers selected form the group consisting of $C_1$–$C_5$ alkyl (meth) acrylates, styrene, $C_1$–$C_4$ alkyl styrenes, and vinyl esters of $C_2$–$C_{12}$ carboxylic acids, and (c) 0–40 wt % of functionalized comonomers selected from the group consisting of functionalized (meth) acrylic acid esters and amides, and vinyl heterocyclic compounds, all of the above amounts based on the weight of the graft copolymer.

The composition is especially useful as a lubricating oil additive with viscosity index-improving effect.

20 Claims, No Drawings

LUBRICANT ADDITIVES

BACKGROUND OF THE INVENTION

1. Field of the Invention

The invention concerns comb copolymers obtained from macromonomers as lubricant additives with viscosity index-improving and dispersing properties.

2. Description of the Background

For some time, so-called comb polymers have been available and, for example, have been used as polymeric stabilizers for emulsions (see G. Allen, J. C. Bevington, *Comprehensive Polymer Science* Vol. 4, pages 248–250, Pergamon Press 1989).

The radically initiated copolymerization of macromonomers with (chemically different) comonomers provides such comb polymers. U.S. Pat. No. 5,254,632 discloses a relatively simple method for the preparation of suitable macromonomers, in which (meth)acrylic acid esters are polymerized in the presence of a hydroxy group-containing sulfur regulator, and the hydroxy group-terminated polyalkyl (meth)acrylates thus obtained are transesterified with methyl methacrylate to form poly(meth)acrylate macromonomers with a methacryloyl end group. The U.S. patent also gives a compilation of pertinent literature in which, among other things, various ways to prepare macromonomers are described.

The comb polymers are suitable for various fields of application, wherein on the basis of the structures, their use as emulsifiers is of particular interest. Their structural features do not necessarily suggest a special suitability as viscosity index improvers (VI improvers) in lubricating oils.

On the other hand, there is a need for effective VI improvers, in particular also dispersion-effective VI improvers, as lubricant additives. It was then discovered that lubricant additives in accordance with the present invention and based on certain comb polymers, particularly fulfill the requirements of lubricant technology.

SUMMARY OF THE INVENTION

The invention concerns a composition comprising a carrier (TM) and a comb copolymer (PFP) made by copolymerizing a polyalkyl (meth)acrylate macromonomer (A), present in an amount of 10–90 wt %, with the following monomers in a total amount of 90–10 wt %:

(a) 0–90 wt % of $C_5$–$C_{30}$ alkyl (meth)acrylates (AMA), (b) 0–60 wt % of nonfunctionalized comonomers (B) selected form the group consisting of $C_1$–$C_5$ alkyl (meth)acrylates, styrene, $C_1$–$C_4$ alkyl styrenes, and vinyl esters of $C_2$–$C_{12}$ carboxylic acids, and (c) 0–40 wt % of functionalized comonomers (C) selected from the group consisting of functionalized (meth) acrylic acid esters and amides, and vinyl heterocyclic compounds, all of the above amounts based on the weight of the comb copolymer.

The composition is especially useful as a lubricating oil additive with viscosity index-improving effect.

As a rule, the components, from which the comb copolymer PFP is synthesized, are in the following weight relations: (sum of the fractions in general=100 wt %).

Macromonomers (A)=10–90 wt %;

$C_5$–$C_{30}$ alkyl (meth)acrylates, (AMA)=0–90 wt %;

nonfunctionalized comonomers, (B)=0–60 wt %; and functionalized comonomers (C)=0–40 wt %.

DESCRIPTION OF THE PREFERRED EMBODIMENTS

In a preferred embodiment of the invention, the structure of the graft copolymer PFP to be used is schematically given by the following formula I, but it is understood that the invention is not limited thereto.

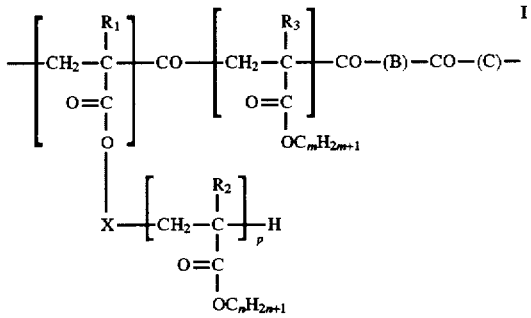

I

X=biradical residue $R_1$=—H or —$CH_3$ $R_2$=—H or —$CH_3$ $R_3$=—H or —$CH_3$ n=6 to 30 m=6 to 30 p=average degree of polymerization of the macromonomer (A)

-co-="copolymerized with", as conventionally used.

In the preparation of the comb copolymer PFP, it is preferable to start with the macromonomers of formula II:

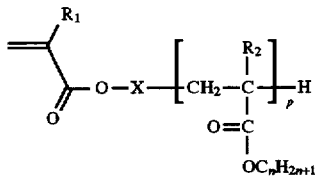

II

X=biradical residue $R_1$=—H or —$CH_3$ $R_2$=—H or —$CH_3$ n=6 to 30 p=average degree of polymerization of the macromonomer p is preferably dimensioned in such a way that $M_w$, the weight-average molecular weight of the macromonomer of formula II, lies in the range of 1,000 to 100,000. Preferably, the biradical residue X stands for an at least two- and up to 30-membered hydrocarbon chain, preferably with a terminal -S-bridge on the end of the chain remote from the carbon which is attached to the oxygen atom in formula II, wherein up to 9 carbon members can be replaced by an ether oxygen. Also, in residue X, the chain can also be interrupted by functional residues of the formula:

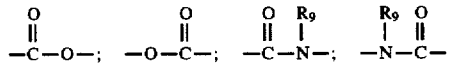

wherein $R_9$ stands for hydrogen or an alkyl of 1–8 carbon atoms, or phenyl.

The alkyl(meth)acrylates AMA can generally be expressed by formula III:

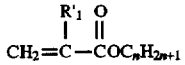

III $R'_1$=H or —$CH_3$ n=6 to 30

The comonomers (B) correspond to formulas IV, V or VI:

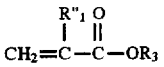

IV $R''_1$=H or $CH_3$ $R_3$=$C_1$–$C_5$ alkyl, preferably $C_1$–$C_4$ alkyl or formula V:

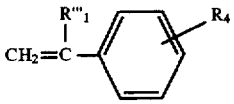

V $R'''_1$=H or $CH_3$ $R_4$=H or $C_1$–$C_4$ alkyl or formula VI:

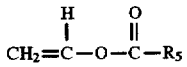

VI $R_5$=$C_1$–$C_{11}$ alkyl.

Vinyl acetate, vinyl propionate, vinyl isobutyrate, vinyl-2-ethylhexoate, vinyl esters of coconut fatty acids, $C_{10}$ oxo acids (see *Kirk-Othmer*, 3rd Ed. Vol 4, 863–871, J. Wiley 1978), are representative of the comonomers of formula VI; in particular, methyl methacrylate (monomer IV-a) is representative of formula IV.

The functionalized (not identical with the aforementioned comonomers), in particular dispersion-active, comonomers (C) correspond preferably to formula VII:

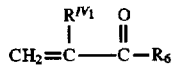

VII wherein $R^{IV}_1$ is hydrogen or methyl; $R_6$ is —$OR_9$ or —$NR_7R_8$, wherein $R_9$ is a hydrophilic residue A containing a group selected from the group consisting of hydroxy, —$NR'_7R'_8$, sulfonic acid, carboxyl, carboxamide, or is alkyl of 2 to 20 carbon atoms substituted with a five- to six-membered heterocycle, wherein the carbon chain can be interrupted by ether bridges or terminally occupied with a phenyl or phenoxy group, optionally substituted with $C_1$–$C_{12}$ alkyl, and wherein $R'_7$ and $R'_8$ each are hydrogen or an alkyl of 1 to 6 carbon atoms, optionally substituted with a hydrophilic residue A, or wherein $R'_7$ and $R'_8$ may form a 5- or 6-membered heterocycle, optionally including other nitrogen or oxygen atoms, and wherein $R'_7$ and $R'_8$ each are hydrogen or an alkyl of 1 to 6 carbon atoms, wherein —$NR'_7R'_8$ can optionally be quaternized, and $R_7$ is hydrogen, and $R_8$ is a carboxamido group. Preferably, the functionalized comonomers (C) are selected from the group consisting of optionally substituted (meth)acrylamide, hydroxyalkyl esters of (meth)acrylic acid, such as 2-hydroxyethyl (meth)acrylate, 2-hydroxypropyl (meth) acrylate, amine-substituted alkyl esters, such as 2-diethylaminoethyl (meth)acrylate, 2-(1-imidazolyl)ethyl (meth)acrylate, 2-(4-morpholinyl)ethyl (meth)acrylate, 2-trimethylammonium ethyl (meth)acrylate salt, hydroxyalkyl-substituted (meth)acrylamides, such as N-(2-hydroxyethyl) (meth)acrylamide, N-(3-hydroxy-2,2-dimethylpropyl) (meth)acrylamide, N-dimethylaminoethyl (meth)acrylamide, N-(meth)acryloidopyrrolidone-2-, N-(meth)acrylamidoethylpyrrolidone, N-(1-piperidinylethyl) (meth)acrylamide, quaternary ammonium compounds, such as N-trimethylammonium propyl (meth) acrylamide salt, sulfonic acid derivatives, such as 2-(meth) acrylamido-2-methylpropanesulfonic acid or N-(meth) acryloylurea.

Of particular interest are monomers of formula VII, wherein $R_6$ is a residue of an alkoxylated alkanol or phenol (comonomers of formula VII-A).

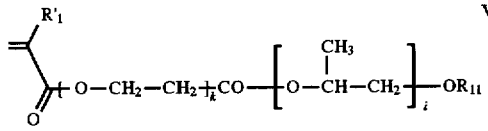

VII-A $R_1$=—H or —$CH_3$ k=5 to 100 i=0 to 100

$R_{11}$=$C_nH_{2n+1}$, branched or unbranched, or substituted phenol n=1 to 22

Representatives of formula VII-A, in which $R_{11}$ is derived from technical phenols or phenol mixtures, are to be regarded as particularly favorable. Such phenols include, in addition to phenol itself, tert-butylphenol, octylphenol, nonylphenol, dinonylphenol.

Furthermore, the functionalized comonomers (C) can belong to the group of formula VIII:

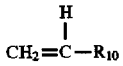

VIII wherein $R_{10}$ is at least one nitrogen atom-containing, 5- or 6-membered heterocycle. Preferably, the comonomers of formula VIII are selected from the group consisting of vinylpyrrolidones, such as 1-vinyl-2-pyrrolidone, vinylimidazole, N-vinylcarbazole, N-vinylsuccinimide, N-vinyloxazolidone, N-vinylphthalimide, and vinylpyridines, such as 2-vinylpyridine.

Preferred are 2-(N-morpholinyl)ethyl methacrylate (monomer VII-a) and N-vinylpyrrolidone (monomer VIII-a).

As starting products for the preparation of comb copolymer PFP, functionalized poly(meth)acrylate macromonomers can also be used. Preferably, these fall under formula II-A:

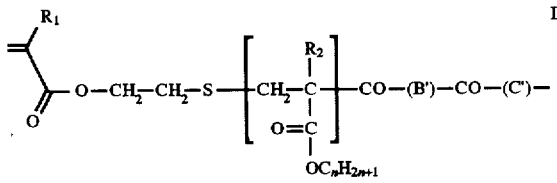

II-A $R_1$=—H or —$CH_3$ $R_2$=—H or —$CH_3$ n=5 to 30 wherein (B') and (C') have the same meanings as (B) and (C), respectively.

Weight-average molecular weight of the macromonomers may be $M_w$=1,000 to 100,000.

Macromonomer II-A can thereby be prepared according to the following weight relations: fraction AMA, 0–90 wt %; fraction comonomer (B'), 0–40 wt %; fraction (C'), 0–100 wt %.

The invention can make advantageous use of the method for the preparation of macromonomers of general formula II:

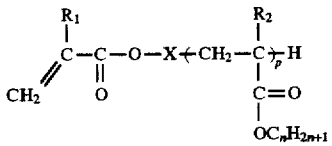

II wherein $R_1$ and $R_2$ are each hydrogen or methyl;

X is a biradical residue; and n is a whole number from 5 to 30, provided that p is so dimensioned that the molecular weight M of macromonomers II lies in the range 1,000 to 100,000 g/mol, in accordance with DE-A 4,121,811 or U.S. Pat. No. 5,254,632, wherein monomeric esters of formula IX:

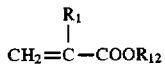

IX wherein $R_{12}$ is an alkyl of 1 to 8 carbon atoms, is transesterified with a hydroxy group-terminated polyalkyl methacrylate of formula X:

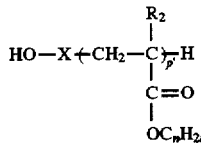

X wherein X, $R_2$, and n have the meanings designated above, provided that p' agrees with p with the splitting off of the alcohol $HOR_{12}$, wherein the compound of formula II is formed.

According to the preferred preparation method of the macromonomers, the compounds of formula X are obtained by polymerizing the monomers or monomer mixtures of the (meth)acrylic esters in the presence of an OH-functional regulator, preferably a sulfur regulator, for example in the presence of 2-mercaptoethanol (see U.S. Pat. No. 5,254,632). In the latter case, X assumes the structure $—(CH_2)_2S—$. However, other methods of the state of the art, which are suitable for the preparation of a PAMA macromonomer with the same monomer composition with a relatively high functionality on the terminal polymerizable (activated) double bond (see European Patent No. 261,942), can also be used successfully. Of particular significance are macromonomers (A), synthesized from (meth)acrylic acid esters of commercial mixtures of alcohols in the claimed $C_6$–$C_{30}$ range, in particular in the range of average C numbers of approximately 10 to approximately 20, particularly also in the range of approximately 12–18, especially with the main focus in the range of 12.2–15. For example, the methacrylic esters of a mixture of $C_{11}$–$C_{16}$ alcohols with an average C number of 13.2–13.8 (commercial product Dobanol 25L from Shell AG) are preferable.

The carrier medium TM for the graft copolymer PFP, includes inert, predominantly lipophilic solvents of the type which is common in additive technology, in particular mineral oils, for example of the type of SN100, such as Shell SM 920 or also gas oils, such as Shell G07.

The macromonomers can be prepared in accordance with U.S. Pat. No. 5,254,632 or on the basis of DE-A 2,318,809; W. Radke, A. H. E. Mueller, Polym. Prepr. (Am. Chem. Soc. Div. Polym. Chem) 32(1) 1991 and H. Rauch-Puntigam, Th. Voelker, *Acrylic and Methacrylic Compounds*, Springer Verlag 1967.

Preparation of the macromonomers (A)

Preparation of the hydroxy group-containing precursor

A mixture of the alkyl (meth)acrylates AMA is present together with the molecular weight regulator, such as mercaptoethanol—for example, approximately 1.0 wt %, based on the monomers—in a suitable reaction vessel, such as a three-neck flask with heating, stirring device, interior thermometer, gas inlet device, and reflux condenser in, for example, approximately 10 times the quantity of the carrier medium TM, and this is heated, while introducing a protective gas, such as nitrogen, for example, to 95° C. The initiator, for example, a per compound, which is, in fact, common, such as a peroxy ester—for example, tert-butyl-2-ethylhexanoate—and the AMA monomer is then metered in, preferably in a mixture with the other initiator—for example, approximately 0.4 wt % initiator, based on the monomers, for approximately 3.5 h. Advantageously, after the inflow has ended, approximately half of the initiator is added at certain intervals—for example, after 2.5 and 5 h—and over a longer period of time, approximately 12 h, the temperature is maintained at approximately 95° C. Subsequently, dilution is appropriately carried out with the carrier medium TM.

Transesterification

In a suitable reaction vessel, for example, a 6-L three-neck flask with heating, stirring device, interior thermometer, air inlet, and packed column with regulator-controlled steam conduit, a mixture of the hydroxy group-containing precursor with methyl (meth)acrylate (MMA)—for example, in a weight ratio of approximately 4.3:3—is preferably present, together with at least a polymerization inhibitor, which is, in fact, known, for example, hydroquinone monomethyl ether, and a stabilizer, for example, of the HALS type—for example, 4-hydroxy-2,2,6,6-tetramethylpiperidine-1-oxide—in the usual quantities, and this is appropriately heated to reflux while conducting air through. In the following, MMA is assumed to be the transesterification component. After a certain fraction has gone over, the transesterification catalyst—preferably a lithium compound, such as lithium methoxide—is added (for example, approximately 0.1%, based on the methacrylic acid methyl ester, is added) and the mixture is maintained at reflux until the boiling temperature has dropped to approximately 65–68° C. Subsequently, more methanol-rich distillate is drawn off until a more extensive reaction is indicated by a rise in the boiling temperature—for example, 100° C. After distilling off more distillate (at 100° C.), the batch is cooled to room temperature and filtered. The excess methyl ester is advantageously removed on a vacuum rotary evaporator. The macromonomer A is obtained dissolved in the carrier medium TM.

Preparation of a high-molecular comb copolymer PFP

From the macromonomer A, preferentially prepared as described above, and the AMA monomer and perhaps the comonomer B in the desired ratio, a mixture is prepared, mixed with carrier medium TM. From this, a smaller part, perhaps 6.5 wt % in approximately 10 times the quantity of carrier medium is used in an apparatus, such as for the preparation of the hydroxy group-containing precursor, is heated at an elevated temperature—for example, 82° C., under a preparative gas such nitrogen. After the addition of residue initiator to the recipient, the additional monomer mixture together with the initiator is added appropriately by continuous pumping, within a certain period of time, for example, 3.5 h. After a longer period of time after the end of the inflow—for example, approximately 12 h, more initiator is added, and after a few more hours, for example, 8 h, allowed to react at an elevated temperature (approximately 82° C.). Subsequently, dilution is carried out appropriately by the addition of carrier medium TM (for example, to an approximately 40% solution).

Preparation of a dispersion-effective comb copolymer

In the apparatus described above, a macromonomer A, preferably with a low molecular weight, is present, together with at least a dispersion-effective monomer C, preferably together with a regulator, in particular a sulfur regulator—for example, approximately 0.1 wt %, based on the macromonomers/monomers—and heated under a protective gas, such as nitrogen, for example, to 100° C. and initiator, for example, of the aforementioned type and in quantities of approximately 0.8 wt % is added. Advantageously at an interval of several h, for example, after 3 and 7 h, more initiator is advantageously added in portions of approximately ⅓ of that already added, and this is maintained over a longer period of time, for example 12 h, at an elevated temperature, for example at 100° C.

Other advantageous variants of the preparation method can be deduced from the examples.

The comb copolymer PFP in accordance with the invention is characterized by an excellent effect as a viscosity index improver. The improved viscosity-temperature characteristic can be demonstrated with the aid of viscosity measurements of model formulations.

Of particular significance is also the noted, excellent dispersion effect in accordance with the invention. The particularly favorable dispersion effectiveness is demonstrated, for example, by results of laboratory tests.

Having generally described this invention, a further understanding can be obtained by reference to certain specific examples which are provided herein for purposes of illustration only and are not intended to be limiting unless otherwise specified.

The determination of the actual viscosity is undertaken according to ASTM D 445. The molecular weight is determined by "size exclusion chromatography" (SEC) with standard PMMA (see H. F. Mark et al., *Encyclopedia of Polymer Science & Engineering*, Vol. 10, pp. 1–19, J. Wiley 1987). The 100 N-oil used in the examples is a Shell SM 920.

Determination of the shear stability (shear stability index) PSSI is undertaken according to ASTM D 2603 Ref. B.

EXAMPLES

Preparation of macromonomers A

A-1

Preparation of a PAMA macromonomer, Mw=19,000

(a) Preparation of the precursor with OH substituent

A mixture is prepared from 1,170 g of the methacrylic acid ester of a mixture of $C_{11}$–$C_{16}$ alkanols (product Dobanol 25L from Shell AG) and 11.7 g 2-mercaptoethanol. In a 4-L three-neck flask with oil bath heating, sausage [saber] stirrer, interior thermometer, $N_2$ carry-over conduit, and reflux condenser, 14.4 g of this monomer mixture and 130 g 100 N-oil are present and heated to 95° C. After the addition of 1.18 g tert-butyl peroxy-2-ethylhexanoate as initiator, a mixture of 1,167.3 g of the $C_{11}$–$C_{18}$ methacrylic acid ester and 3.5 g initiator are added uniformly via a pump within 3.5 h. 2.5 and 5 h after the end of the inflow, 2.34 g tert-butyl peroxy-2-ethylhexanoate are added and the mixture is maintained at 95° C. for another 12 h. Afterwards, dilution is carried out with 497.2 g 100 N-oil.

The actual viscosity is determined as KV100=77.6 cSt.

The molecular weight was determined by SEC. $M_w$=19,000 g/mol (b) Transesterification In a 6-L three-neck flask with an electrical heating mantle, sausage stirrer, interior thermometer, air inlet, and packed column with regulator-controlled steam distributor, a mixture of 1,760.4 g of the product from (a) and 1,260 g methyl methacrylate, 0.06 g 4-hydroxy-2,2,6,6-tetramethylpiperidin-1-oxyl, and 0.23 g hydroquinone monomethyl ether is present and heated to reflux while air is conducted through. After the removal of 118 g distillate, 1.15 g lithium methoxide is added and maintained at reflux until the boiling temperature has fallen to 65° to 68° C. Afterwards, methanol-rich distillate (65°–68° C., approximately 17 g) is removed, until an extensive reaction is indicated by an increase of the boiling temperature to 100° C. After distilling off another 280 g distillate at 100° C., the batch is cooled to room temperature and filtered clear through a Seitz-KS80 filter layer. The excess methyl methacrylate is removed on a vacuum rotary evaporator.

Yield: 1,750 g oil solution of macromonomer A-1

A-2

Preparation of a PAMA macromonomer $M_w$=5,500.

(a) Preparation of the precursor with OH substituent

The same apparatus is used as under A-1 (a). In a 6-L flask, the following components are present: 1,396 g 100 N-oil, 155.1 g methacrylic acid ester of a mixture of $C_{11}$–$C_{16}$ alkanols (product Dobanol 25 L), and 4.65 g 2-mercaptoethanol, heated to 110° C. under nitrogen. After the addition of 1.65 g tert-butyl peroxy-2-ethylhexanoate, a mixture of 2,448.9 g of the same methacrylic acid ester, 75.3 g 2-mercaptoethanol, and 24.5 g tert-butyl peroxy-2-ethylhexanoate are continuously pumped in within 3.5 h. 45 min and 90 min after the end of the inflow, 5.2 g initiator are subsequently added and the batch is maintained at 100° C. for another 2 h. The result exhibits a viscosity of 20.9 cSt at 100° C.

Yield: 4,038 g

Actual viscosity KV 100 20.9 cSt

Molecular weight (SEC) 5,500 g/mol (b) The transesterification is undertaken analogous to A-1(b) (with the same weight ratios of-the starting substances), but in the 10-L three-neck flask with the entire product from (a).

Yield: approximately 4,000 g of macromonomer A-2

A-3

Preparation of a PAMA macromonomer $M_w$=7,720

(a) Preparation of the precursor

The same apparatus is used as in Example A-1(a). The following components were present in the 6-L flask: 1,396 g 100 N-oil, 155. 1 g methacrylic acid ester of a mixture of $C_{11}$–$C_{16}$ alkanols (product Dobanol 25L), and 3.10 g 2-mercaptoethanol, heated to 110° C. under nitrogen. After the addition of 1.65 g tert-butyl peroxy-2-ethylhexanoate (initiator), a mixture of 2,448.9 g of the same methacrylic acid ester, 49.0 g 2-mercaptoethanol, and 24.5 g initiator are continuously pumped in within 3.5 h. 45 min and 90 min after the end of the inflow, 5.2 g initiator are subsequently added, and the batch is maintained at 110° C. for another 12 h.

Actual viscosity KV 100 21 cSt

Molecular weight (SEC) 7,720 g/mol (b) Transesterification, analogous to Example A-2(b); yield: approximately 4,000 g oil solution of the macromonomer A-3

A-4

Preparation of a PAMA macromonomer $M_w$=13,600

(a) Preparation of the precursor

The same apparatus as for Example A-1(a). The following components are present in the 6-L flask: 1.396 g 100 N-oil, 155.1 g methacrylic acid ester of a mixture of $C_{11}$–$C_{16}$ alkanols (product Dobanol 25L) and 1.55 g 2-mercaptoethanol and are heated to 110° C. under nitrogen. After addition of 1.653 tert-butyl peroxy-2-ethylhexanoate, a mixture of 2.448.9 g of the methacrylic ester mentioned above, 25.5 g 2-mercaptoethanol, and 24.5 g tert-butyl peroxy-2-ethylhexanoate are continuously pumped in within 3.5 h. 45 min and 90 min after the end of the inflow, 5.2 g butyl per-2-ethylhexanoate are subsequently added, and the batch is maintained at 110° C. for another 12 h.

Actual viscosity KV 100=52 cSt

Molecular weight (SEC)=13.600 g/mol (b) The transesterification is carried out analogous to Example A-2(b). Yield: approximately 4.500 g oil solution of macromonomer A-4

Preparation of the comb copolymers PFP from the macromonomers

PFP-1

Preparation of a high-molecular comb copolymer

An apparatus is used according to Example A-1(a). The monomer mixture is prepared from 227.7 g macromonomer from Example A-1, 106.3 g methacrylic acid ester of a mixture of $C_{11}$–$C_{16}$ alkanols (product Dobanol 25 L), and 45.5 g methyl methacrylate; 24.5 g of this monomer mixture are present with 220.5 g 100 N-oil in the apparatus and heated to 82° C. under nitrogen. After addition of 0.88 g tert-butyl peroxy-2-ethylhexanoate, to the recipient, 355 g monomer mixture, together with 0.56 g tert-butyl peroxy-2-ethylhexanoate are continuously pumped in within 3.5 h. 12 h after the end of the inflow, another 0.5 g tert-butyl per-2-hexanoate is added and postreacted at 82° C. for 8 h. Afterwards, dilution is carried out by the addition of 150 g 100 N-oil.

Yield: 600 g oil solution of the graft copolymer PFP-1

PFP-2

Preparation of a dispersion-effective comb copolymer

The apparatus is used according to Example A-1(a). 122.9 g of the macromonomer from Example A-2, 20.0 g 2-(N-morpholinyl)ethyl methacrylate and 0.15 g dodecyl mercaptan are present in the three-neck flask and heated to 100° C. under nitrogen, and afterwards, 1.0 g tert-butyl peroxy-2-ethylhexanoate is added. After 3 or 7 h after the first initiator addition, another 0.2 g tert-butyl peroxy-2-ethylhexanoate are added, and the batch is maintained at 100° C. for another 12 h.

Yield: 143 g oil solution of the comb copolymer PFP-2

PFP-3

Preparation of a dispersion-effective comb copolymer

Apparatus as in Example A-1(a). 122.9 g of the macromonomer from Example A-3, 20 g 2-(N-morpholinyl) ethyl methacrylate, and 0.15 g dodecyl mercaptan are present in a three-neck flask and heated to 100° C. under nitrogen. Afterwards, 1.0 g tert-butyl peroxy-2-ethylhexanoate are added. After 3 or 7 h after the first addition of the initiator, another 0.2 g initiator is added, and the batch is maintained at 100° C. for another 12 h.

Yield: 143 g oil solution of the comb copolymer PFP-3

PFP-4

Preparation of a dispersion-effective comb copolymer

Apparatus as in Example A-1. 138.2 g of the macromonomer from Example A-4, 10 g 2-(N-morpholinyl)ethyl methacrylate, and 0.15 g dodecyl mercaptan are present in a three-neck flask and heated to 100° C. under nitrogen. Afterwards, 1.0 g tert-butyl peroxy-2-ethylhexanoate is added. After 3 or 7 h after the addition of the initiator, another 0.2 g initiator is added, and the batch is maintained at 100° C. for another 12 h.

Yield: 148 g oil solution of the comb copolymer PFP-4

PFP-5

Preparation of a dispersion-effective comb copolymer

Apparatus as in Example A-1(a). 138.2 g of the macromonomer according to Example A-2, 5.0 g 2-(N-morpholinyl)ethyl methacrylate, 5.0 g N-vinylpyrrolidone, and 0.15 g dodecyl mercaptan are present in a three-neck flask and heated to 100° C. under nitrogen. Afterwards, 1.0 g tert-butyl-2-ethylhexanoate is added. 3 or 7 h after the first initiator addition, another 0.2 g tert-butyl peroxy-2-ethylhexanoate are added, and the batch is maintained at 100° C. for another 12 h.

Yield: 148 g oil solution of the comb copolymer PFP-5

PFP-6

Preparation of a high-molecular comb copolymer

An apparatus according to Example A-1(a) is used. The monomer mixture is prepared from 299.5 g macromonomer from Example A-1, 65 g methacrylic acid ester of a mixture of $C_{11}$ to $C_{16}$ alkanols (product Dobanol 25 L), 65.0 g methyl methacrylate, and 70.5 g 100 N-oil; 50 g of this monomer mixture are present in the apparatus and heated to 90° C. under nitrogen. After the addition of 0.06 g tert-butyl peroxy-2-ethylhexanoate to the recipient, 450 g of the monomer mixture, together with 0.59 g tert-butyl-2-ethylhexanoate, are continuously pumped in within 3.5 h. 1.5 h after the end of the inflow, 312.5 g 100 N-oil are added for the dilution. 6 h after the end of the inflow, another 0.65 q tert-butyl peroxy-2-ethylhexanoate are added and subsequently reacted for 8 h.

Yield: 812 g oil solution of the graft copolymer PFP-6

PFP-7

Preparation of a high-molecular comb copolymer

An apparatus according to Example A-1(a) is used. The monomer mixture is prepared from 276.5 g macromonomer from Example A-1, 120.0 g n-butyl methacrylate, and 103.5 g 100 N-oil. 75 g of this monomer mixture are present in the apparatus and heated to 90° C. under nitrogen. After the addition of 0.09 g tert-butyl peroxy-2-ethylhexanoate to the recipient, 425 g of the monomer mixture, together with 0.51 g tert-butyl peroxy-2-ethylhexanoate, are continuously pumped in within 3.5 h. 6 h after the end of the inflow, another 0.6 g tert-butyl peroxy-2-ethylhexanoate is added and postreacted for 8 h. Afterwards, dilution is carried out by the addition of 100 g 100 N-oil.

Yield: 600 g oil solution of the graft copolymer PFP-7

PFP-8

Preparation of a high-molecular comb copolymer

An apparatus according to Example A-1(a) is used. The monomer mixture is prepared from 207.4 g macromonomer from Example A-1, 165.0 g n-butyl methacrylate, and 127.6 g 100 N-oil. 75 g of this monomer mixture are present in the apparatus and heated to 85° C. under nitrogen. After the addition of 0.09 g tert-butyl peroxy-2-ethylhexanoate to the recipient, 425 g of the monomer mixture, together with 0.51 g tert-butyl per-2-ethyl hexanoate, are continuously pumped in within 3.5 h. 1.5 h after the end of the inflow, 250 g 100 N-oil are added for the dilution. 6 h after the end of the inflow, another 0.6 g tert-butyl peroxy-2-ethylhexanoate are added and postreacted for 8 h. Afterwards, 450 g 100 N-oil are added for a further dilution.

Yield: 1,200 oil solution of the graft copolymer PFP-8

Tests

For the testing of the emulsifier effect of the graft copolymer in accordance with the invention, the toluene/water emulsifying test indicated below can be used. For the testing of the spot dispersing effect the carbon black spot test can be used.

Execution of the toluene/water emulsifying test:

The additive to be tested for its emulsifying effect is dissolved in toluene (mixed with 20 ppm Oracet Blue B) with a polymer concentration of 1 wt %. 7 mL distilled water and 13 mL of 1 wt % toluene solution are poured into a graduated 20 mL test tube with ground stopper one after the other, and temperature-controlled at 30° C. in a water bath for 15 min. After vigorously shaking the test tube, a uniform emulsion is produced and the sample is placed back in the temperature-control bath. The separation of the emulsion into the layers of toluene, emulsion, and water is observed over a time period of 24 h. Moreover, the toluene/emulsion layer limit and the emulsion/water layer limit are read off with the aid of the graduation at the times of 5 min, 10 min, 100 min, and 24 h.

Evaluation

The quantification of the emulsification effect in % values is carried out according to a scheme wherein a graph is plotted of volume as the y-axis and the logarithm of time as the x-axis, and the fraction of the emulsion present in the observation time period 5 min to 24 h is characterized by the ratio of an area A to a total area A+B and indicated in % values.

Execution of the carbon black spot test

With the additive to be tested, two stock solutions are mixed up in 150 N-oil (Enerpar 11): stock solution I with 0.375% polymer content and stock solution II with 0.75% polymer content. From each stock solution, 2 carbon black dispersion solutions are prepared (double determination). To this end, 1.5 g carbon black (flame carbon black, Degussa Special Black 4) and 50 g stock solution are weighed in a 150-mL beaker and then stirred up with an Ultra-Turrax intensive stirrer for 30 min at 9,000 rpm. Afterwards, 20 µl of each dispersion solution are tested by spotting on filter paper (Durieux 122 paper). After 48 h of flat storage at 30° C., the spots are evaluated. To this end, the diameter of the carbon black spot and the diameter of the oil spot surrounding it are measured and their ratio indicated in %.

Individual evaluation

Diameter carbon black/diameter oil spot +100%. The total evaluation of the spot test is produced as the sum of the four individual percentage evaluations. Products with poor carbon black dispersion produce total evaluation of approximately 70% and lower; products with good carbon black dispersion produce total evaluations of ≧130%.

Comparison of the rheological characteristics of the comb copolymer PFP-1, PFP-6, PFP-7, and PFP-8 with a common market PAMA-VI improver Viscoplex 8-500 from Roehm GmbH is shown in Table I below.

TABLE I

| | Formulation in 150 N-measurement oil | | Capillary viscosimetry | | | Shear stability ASTM D 2603 Ref B | |
|---|---|---|---|---|---|---|---|
| Additive | Wt. % additive | wt % Polymer | 100° C. ($mm^2 S^{-1}$) | 40° C. ($mm^2 S^{-1}$) | VIB | % loss KV 100 | PSSI |
| PFP-1 | 12.5 | 5.0 | 12.32 | 61.37 | 203 | 26.7 | 48.1 |
| PFP-6 | 12.5 | 5.0 | 12.90 | 60.49 | 219 | 32.4 | 56.3 |
| PFP-7 | 10.0 | 5.0 | 12.55 | 53.72 | 241 | 25.5 | 45.5 |
| PFP-8 | 20.0 | 5.0 | 12.71 | 44.51 | 297 | 16.4 | 29.0 |
| VISCOPLEX 8-500 | 9.9 | 5.0 | 12.87 | 70.0 | 187 | 26.0 | 45.3 |

As can be seen from Table I, the PAMA comb copolymer exhibit viscosity index values which are clearly higher, with a comparable thickening effect (KV 100) and comparable shear stability.

TABLE II

| | Formulation in 150 N-measurement oil with 0.3% PPD* | | Capillary viscosimetry | | | | |
|---|---|---|---|---|---|---|---|
| Additive | Wt %. additive | wt % Polymer | 100° C. ($mm^2 S^{-1}$) | 40° C. ($mm^2 S^{-1}$) | 0° C. ($mm^2 S^{-1}$) | −10° C. ($mm^2 S^{-1}$) | −20° C. ($mm^2 S^{-1}$) |
| PFP-1 | 14.45 | 5.78 | 14.08 | 69.29 | 783.6 | 1 714 | 4 683 |
| PFP-6 | 13.75 | 5.50 | 14.23 | 65.65 | 636.1 | 1 503 | 4 395 |
| PFP-7 | 11.20 | 5.60 | 13.91 | 58.47 | 573.3 | 1 287 | 3 814 |
| PFP-8 | 22.0 | 5.50 | 14.05 | 47.75 | 464.9 | 1 071 | 2 936 |
| VISCOPLEX 8-500 | 10.05 | 5.53 | 14.06 | 75.72 | 869.5 | 1 891 | 5 635 |

*) PPD = pour point depressant Viscoplex 1-330

The comparison of the formulations in Table II, adjusted for the same 100° C. viscosity shows, moreover, the clearly lower thickening of the comb copolymer at low temperatures.

TABLE III

| Additive | | Viscosity data in 150 N-measurement oil | | | | | Dispersion evaluation | |
|---|---|---|---|---|---|---|---|---|
| Designation | Composition (wt %) | % Polymer | % Additive | KV 100 ($mm^2 S^{-1}$) | KV 40 ($mm^2 S^{-1}$) | VIB ($mm^2 S^{-1}$) | TW-Test | Carbon Black Spot Test |
| PFP-2 | Macromonomer A-2/Monomer VII-a (80-20) | 70 | 11.43 | 8.39 | 48.8 | 148 | 17% | 130% |
| PFP-3 | Macromonomer A-3/Monomer VII-a (80-20) | 70 | 11.43 | 8.07 | 47.8 | 141 | 21% | 145% |
| PFP-4 | Macromonomer A-4/Monomer VII-a (90-10) | 67.5 | 11.85 | 8.69 | 52.4 | 143 | 11% | 156% |
| PFP-5 | Macromonomer A-1/Monomer VII-a + Monomer VIII-a (90-5-5) | 67.5 | 11.85 | 10.21 | 61.2 | 155 | 36% | 132% |

The PAMA comb copolymer listed in Table III exhibit a good effectiveness, both in T/W test and also in the carbon black spot test. Comparable linear PAMA copolymers with the same gross composition produce a good evaluation in the carbon black spot test, but do not exhibit any interface activity in the T/W test.

The disclosure of German patent application No. 195 18 786.5, filed May 22, 1995, is hereby incorporated by reference.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A composition comprising a carrier and a comb copolymer made by copolymerizing to a polyalkyl (meth)acrylate macromonomer, present in an amount of 10–90 wt %, the following monomers in a total amount of 90–10 wt %:

(a) 0–90 wt % of $C_6$–$C_{30}$ alkyl (meth)acrylates, (b) 0–60 wt % of nonfunctionalized comonomers selected from the group consisting of $C_1$–$C_5$ alkyl (meth) acrylates, styrene, $C_1$–$C_4$ alkyl styrenes, and vinyl esters of $C_2$–$C_{12}$ carboxylic acids, and (c) a dispersion-effective amount of functionalized comonomers selected from the group consisting of finctionalized (meth)acrylic acid esters and amides, and vinyl heterocyclic compounds, all of the above amounts based on the weight of the graft copolymer.

2. The composition of claim 1, wherein the polyalkyl (meth)acrylate macromonomer has the following formula II:

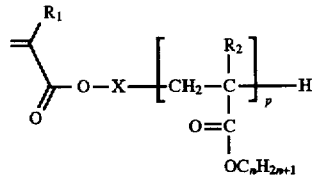

II

X=biradical residue $R_1$=—H or —$CH_3$ $R_2$=—H or —$CH_3$ n=6 to 30 p=average degree of polymerization of the macromonomer, provided that $M_w$, the weight-average molecular weight of the macromonomer of formula II, lies in the range 1,000 to 100,000.

3. The composition of claim 1, wherein the weight-average molecular weight of the comb copolymer lies in the range 5,000 to 1,000,000.

4. The composition of claim 2, wherein the weight-average molecular weight of the comb copolymer lies in the range 5,000 to 1,000,000.

5. A comb copolymer made by copolymerizing a polyalkyl (meth)acrylate macromonomer, present in an amount of 10–90 wt %, with the following monomers in a total amount of 90–10 wt %:

(a) 0–90 wt % of $C_6$–$C_{30}$ alkyl (meth)acrylates, (b) 0–60 wt % of nonfunctionalized comonomers selected form the group consisting of $C_1$–$C_5$ alkyl (meth) acrylates, styrene, $C_1$–$C_4$ alkyl styrenes, and vinyl esters of $C_2$–$C_{12}$ carboxylic acids, and (c) a dispersion effective amount of functionalized comonomers selected from the group consisting of finctionalized (meth)acrylic acid esters and amides, and vinyl heterocyclic compounds, all of the above amounts based on the weight of the comb copolymer, wherein the polyalkyl (meth)acrylate macromonomer comprises (d) 0–90 wt % of $C_6$–$C_{30}$ alkyl (meth)acrylates, (e) 0–40 wt % of nonfunctionalized comonomers selected form the group consisting of $C_1$–$C_5$ alkyl (meth) acrylates, styrene, $C_1$–$C_4$ alkyl styrenes, and vinyl esters of $C_2$–$C_{12}$ carboxylic acids, and (f) a dispersion effective amount of functionalized comonomers selected from the group consisting of finctionalized (meth)acrylic acid esters and amides, and vinyl heterocyclic compounds, the total amounts of (d), (e) and (f) adding up to 100% of said macromonomer.

6. A composition containing a carrier and the graft copolymer of claim 5.

7. The composition of claim 1 wherein the graft copolymer has the following formula I:

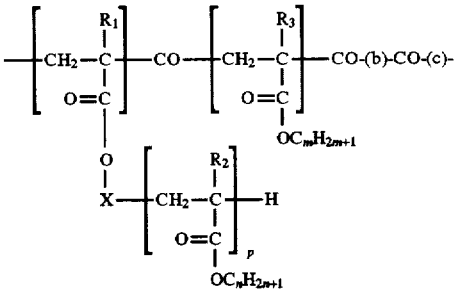

X=biradical residue $R_1$=—H or —$CH_3$ $R_2$=—H or —$CH_3$ $R_3$=—H or —$CH_3$ n=6 to 30 m=6 to 30 p=average degree of polymerization of the macromonomer, and -co-=copolymerized with.

8. The composition of claim 1, wherein the nonfunctionalized comonomer is methyl methacrylate or butyl methacrylate.

9. The composition of claim 1, wherein the functionalized comonomer is selected from the group consisting of vinylpyrrolidones, vinylimidazole, N-vinylcarbazole, N-vinylsuccinimide, N-vinyloxazolidone, N-vinylphthalimide, and vinylpyridines.

10. The composition of claim 1, wherein the functionalized comonomer is 2-(N-morpholinyl)ethyl methacrylate or N-vinylpyrrolidone.

11. A lubricating composition containing a lubricating oil and a viscosity index improving amount of a comb copolymer made by copolymerizing to a polyalkyl (meth)acrylate macromonomer, present in an amount of 10–90 wt %, the following monomers in a total amount of 90–10 wt %:

(a) 0–90 wt % of $C_6$–$C_{30}$ alkyl (meth)acrylates, (b) 0–60 wt % of nonfunctionalized comonomers selected from the group consisting of $C_1$–$C_5$ alkyl (meth) acrylates, styrene, $C_1$–$C_4$ alkyl styrenes, and vinyl esters of $C_2$–$C_{12}$ carboxylic acids, and (c) 0–40 wt % of functionalized comonomers selected from the group consisting of functionalized (meth) acrylic acid esters and amides, and vinyl heterocyclic compounds, all of the above amounts based on the weight of the graft copolymer.

12. The composition of claim 11, wherein the polyalkyl (meth)acrylate macromonomer has the following formula II:

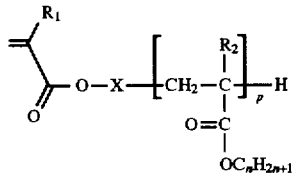

X=biradical residue $R_1$=—H or —$CH_3$ $R_2$=—H or —$CH_3$ n=6 to 30 p=average degree of polymerization of the macromonomer, provided that $M_w$, the weight-average molecular weight of the macromonomer of formula II, lies in the range 1,000 to 100,000.

13. The composition of claim 11, wherein the weight-average molecular weight of the comb copolymer lies in the range 5,000 to 1,000,000.

14. The composition of claim 22, wherein the weight-average molecular weight of the comb copolymer lies in the range 5,000 to 1,000,000.

15. A lubricating composition containing a lubricating oil and a viscosity index improving amount of a comb copolymer made by copolymerizing a polyalkyl (meth)acrylate macromonomer, present in an amount of 10–90 wt %, with the following monomers in a total amount of 90–10 wt %:

(a) 0–90 wt % of $C_6$–$C_{30}$ alkyl (meth)acrylates, (b) 0–60 wt % of nonfunctionalized comonomers selected form the group consisting of $C_1$–$C_5$ alkyl (meth) acrylates, styrene, $C_1$–$C_4$ alkyl styrenes, and vinyl esters of $C_2$–$C_{12}$ carboxylic acids, and (c) 0–40 wt % of functionalized comonomers selected from the group consisting of functionalized (meth) acrylic acid esters and amides, and vinyl heterocyclic compounds, all of the above amounts based on the weight of the comb copolymer, wherein the polyalkyl (meth)acrylate macromonomer comprises (d) 0–90 wt % of $C_6$–$C_{30}$ alkyl (meth)acrylates, (e) 0–40 wt % of nonfunctionalized comonomers selected form the group consisting of $C_1$–$C_5$ alkyl (meth) acrylates, styrene, $C_1$–$C_4$ alkyl styrenes, and vinyl esters of $C_2$–$C_{12}$ carboxylic acids, and (f) 0–100 wt % of functionalized comonomers selected from the group consisting of functionalized (meth) acrylic acid esters and amides, and vinyl heterocyclic compounds, the total amounts of (d), (e) and (f) adding up to 100% of said macromonomer.

16. A composition containing a lubricating oil and the graft copolymer of claim 15.

17. The composition of claim 11 wherein the graft copolymer has the following formula I:

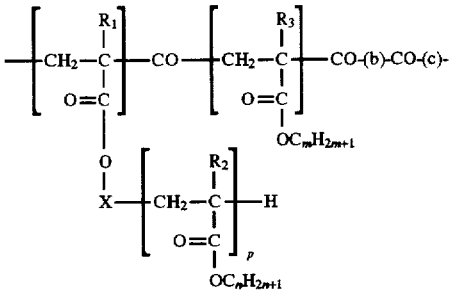

X=biradical residue $R_1$=—H or —$CH_3$ $R_2$=—H or —$CH_3$ $R_3$=—H or —$CH_3$ n=6 to 30 m=6 to 30 p=average degree of polymerization of the macromonomer (A), and -co-=copolymerized with.

18. The composition of claim 11, wherein the nonfunctionalized comonomer is methyl methacrylate or butyl methacrylate.

19. The composition of claim 11, wherein the functionalized comonomer is selected from the group consisting of vinylpyrrolidones, vinylimidazole, N-vinylcarbazole, N-vinylsuccinimide, N-vinyloxazolidone, N-vinylphthalimide, and vinylpyridines.

20. The composition of claim 11, wherein the functionalized comonomer is 2-(N-morpholinyl)ethyl methacrylate or N-vinylpyrrolidone.

* * * * *